United States Patent [19]

Freund

[11] Patent Number: 4,805,816

[45] Date of Patent: Feb. 21, 1989

[54] COMBINATION DISPLAY FORM AND GARMENT HANGER

[75] Inventor: David M. Freund, Syracuse, N.Y.

[73] Assignee: RPM Industries, Inc., Auburn, N.Y.

[21] Appl. No.: 56,101

[22] Filed: Jun. 1, 1987

[51] Int. Cl.[4] ..... A41H 5/00; A47G 25/36

[52] U.S. Cl. ..... 223/66; 223/DIG. 4; 223/85

[58] Field of Search ..... 223/DIG. 4, 85, 87, 223/92, 66, 68; D6/315, 316; 211/113, 119, 124; 248/339, 340; 206/279, 284, 288, 292, 293, 294, 295, 296, 297, 300, 806

[56] References Cited

U.S. PATENT DOCUMENTS

| | | | |
|---|---|---|---|
| Des. 226,943 | 5/1973 | Ahlstrom . | |
| Des. 272,792 | 2/1984 | Marx . | |
| Des. 279,627 | 7/1985 | Morin | D6/315 X |
| 1,321,997 | 11/1919 | Duberstein | 223/92 |
| 2,037,077 | 4/1936 | Knote | 223/92 |
| 2,122,190 | 6/1938 | Wendt | 211/113 X |
| 2,127,941 | 8/1938 | Rock . | |
| 2,169,552 | 8/1939 | Bellin . | |
| 2,558,497 | 6/1951 | Rosen . | |
| 3,044,671 | 7/1962 | Strumpf et al. . | |
| 3,202,328 | 8/1965 | Burrell . | |
| 3,384,231 | 5/1968 | Cox et al. | 248/340 X |
| 3,695,418 | 10/1972 | Gwozdz | 206/806 X |
| 4,542,838 | 9/1985 | Perez-Tubens et al. | 223/87 |

FOREIGN PATENT DOCUMENTS

| | | |
|---|---|---|
| 2147031 | 3/1973 | France . |
| 2365990 | 4/1978 | France . |
| 46553 | 8/1939 | Netherlands . |

OTHER PUBLICATIONS

Advertising Brochure–*Body Girl*, Schamberger Presentation.

*Primary Examiner*—Robert R. Mackey
*Attorney, Agent, or Firm*—Wall and Roehrig

[57] ABSTRACT

A combination garment display form and hanger that includes a molded plastic shell having a front face depicting at least part of a human torso. The shell further contains a hanger slot recessed into the upper part of the shell that is specifically contoured to complement display racks of various sizes and shapes. The shell has a rearwardly disposed peripheral wall about its perimeter that contains spaced strap receiving indentations recessed into the peripheral wall with adjacent indentations being separated with a flat section of wall so that a garment can be wrapped smoothly over the indentations.

6 Claims, 2 Drawing Sheets

COMBINATION DISPLAY FORM AND GARMENT HANGER

BACKGROUND OF THE INVENTION

This invention relates to a means for displaying an article of clothing and, in particular, to a combination garment display form and hanger that can be suspended in vertical alignment from racks of different sizes and shapes.

More specifically, this invention relates to a molded apparel form which is ideally well suited for displaying ladies' swimwear, sportswear, or undergarments and includes a hanger that is recessed into the body section of the form and which is specifically contoured to accept many different types of display racks used throughout the garment industry.

Both French Pat. No. 2,365,990 and U.S. Pat. No. Des. 272,792 each describe molded plastic forms depicting a woman's torso suitable for use in displaying swimwear, sportswear, and other similar garments. In each case, the form is equipped with a thin upwardly extended hook for suspending the form from a display rack. The hook poses a danger to anyone handling the form, can become entangled with foreign objects, and is easily broken. It is also noted that these forms are molded of a smooth plastic. As a consequence, garments displayed on the form can slide about or become dislodged thereby destroying the effectiveness of the display.

A molded torso form has recently been introduced in West Germany that overcomes some of the disadvantages found in the above noted prior art. This form contains a circular hole that is passed horizontally through the front face of the device immediately below its flat top surface. An entranceway is passed downwardly through the top surface and makes a lateral entry into the hole region to create a recessed hanger. The recessed opening is relatively narrow and specifically designed to accommodate only small diameter pipe racks typically used in Europe. The forms, therefore, will not accept thicker racks used in many other geographical locations, and in particular, the rectangular shaped racks which are presently being used in modern stores and shops in this country. The depth of the hanger slot is also relatively shallow and, as a consequence, the recessed hanger opening represents a weak section in form that is susceptible to bending and/or breaking.

The new West German form also includes thin laterally extended tabs along the shoulders and opposing side walls of the form. The tabs are serrated or scalloped to create pointed ribs between which the straps of a displayed garment can be captured to prevent the garment from becoming misaligned on the form. Here again, the protruding ribs pose a danger to persons handling the form. The method of manufacture and separation from surplus material at time of manufacture leaves a sharp edge characterized by particulate extrusions which are especially dangerous at the laterally extended tabs. Said sharpness creates a hazardous condition when dressing or otherwise handling the form. Protruding ribs can also become easily entangled with foreign objects when the form is removed from the rack. It should be further noted that this molded form lacks a neck section so that a halter or similar garment having crossed shoulder straps cannot be effectively displayed.

SUMMARY OF THE INVENTION

It is therefore an object of the present invention to improve molded forms for displaying garments.

A further object of the present invention is to provide a molded display form that has a recessed hanger capable of being suspended from display racks of different sizes and shapes.

A still further object of the present invention is to remove all potentially dangerous protrusions from hanger type garment display forms to minimize breakage and to insure the safety of those handling the forms.

It is also another object of the present invention to provide a more compact and streamlined molded garment form.

These and other objects of the present invention are attained by means of a combination garment display form and hanger that includes a plastic shell having a vertical front face depicting a portion or an entire torso, the shell further including a recessed hanger slot formed in the upper part of the shell that has a contoured aperture centered upon the axis of the form and a vertical entranceway, the contoured aperture containing a circular lower section that opens laterally into the entranceway and a notched upper section that has a first rectangular shaped notch that opens vertically into the circular lower section and a smaller second rectangular shaped notch that opens vertically into the first rectangular section. The shell also includes a rearwardly turned peripheral wall extending about its perimeter in which spaced strap receiving indentations are formed so that adjacent indentations are separated by a flat section whereby a garment can be smoothly passed over the indentations without distortion when so dressed.

BRIEF DESCRIPTION OF THE DRAWINGS

For a better understanding of these and other objects of the present invention, reference is made to the following detailed description of the invention which is to be read in conjunction with the associated drawings, wherein.

DESCRIPTION OF THE INVENTION

Figure 1:
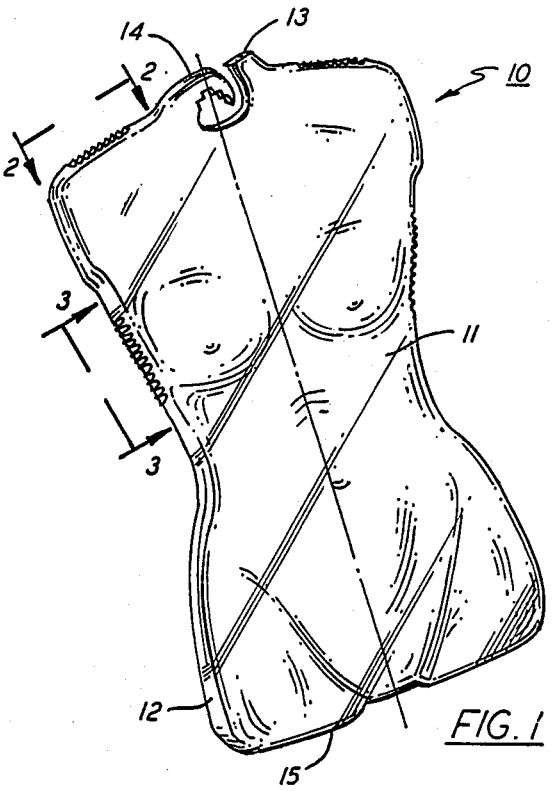
FIG. 1 is a perspective view of a molded display form depicting a woman's torso which embodies the features of the present invention.

Referring initially to FIG. 1, there is shown a display form generally depicted at 10 that embodies the teachings of the present invention. A shell is molded from a single sheet of high strength plastic which is preferably transparent, having a front face 11 depicting a woman's torso. The front surface of the shell is turned 90° to establish a short peripheral wall 12 that runs about the entire perimeter of the form. The peripheral wall gives the appearance of depth to the form, and also serves to increase the overall body strength of the shell structure. The outline of the form is generally rectangular in shape with the distance across the shoulders being about equal to the distance across the hips. The form contains a raised neck section 13, the purpose of which will be explained in greater detail below. The top surface 14 of the neck section is horizontally disposed and is molded in parallel alignment with the bottom surface 15 of the form structure.

Figure 4:
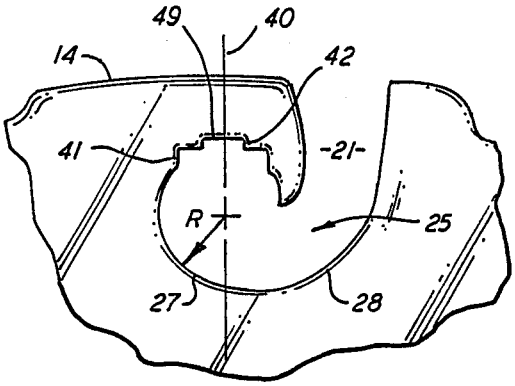
FIG. 4 is an enlarged partial view showing the geometry of the recessed hanger aperture employed in the present invention.

As illustrated in greater detail in FIG. 4, the form of the present invention includes a deeply recessed hanger slot, generally referenced 20. The hanger slot has a vertically disposed entranceway 21 that opens laterally into a contoured aperture 25. The aperture geometry is specifically designed to accommodate racks of different sizes and shapes. A large number of the display racks that are in use today are either circular or rectangular in form with the major axis of the rectangular racks being either horizontally or vertically orientated. It should be further noted that although the exact cross sectional dimensions of the racks may vary, the diameter of the circular racks seldom exceed 1.25 inches while the width of the rectangular racks seldom exceed one inch along the major axis and one-half inch along the minor axis. As will become evident from the disclosure below, the hanger slot of the present invention is specifically contoured to complement any one of these rack shapes and sizes up to the noted values. Therefore, when a form is hung upon a rack, the top surface of the rack will be securely seated against the contoured surface of the hanger slot whereby it will be vertically suspended from the rack and prevented from shifting thereon. Garments mounted upon the forms thus can be most effectively displayed.

The contoured aperture 25 of the hanger slot is generally circular in shape having a radius of about 0.75 inches. The circular wall 27 of the aperture blends into the arcuate shaped side wall 28 of the entranceway to provide a smooth surface for guiding a display rack from the entranceway into the aperture region. The entranceway to the contoured aperture has a minimum width of about 1.25 inches to insure that larger size racks can pass smoothly into the contoured aperture. The aperture is centered upon the vertical axis 40 of the form. A pair of rectangular shaped notches 41 and 42 are formed in the top portion of the circular opening. The notches are also centered upon the axis 40 and each notch is formed to an equal vertical depth of about 0.20 inches. The lower or larger notch is about 1.0 inches wide while the upper smaller notch is about 0.50 inches wide or about half as wide as the lower notch. Here again, the notches are sized to complement the shape of larger size rectangular racks that are orientated either vertically or horizontally.

As should be evident from the disclosure above, the recessed hanger slot has a geometry that can accept round, oval or rectangular shaped racks of various sizes. The rack, once received in the aperture is automatically centered along the axis of the form when the rack is seated against the top of the aperture. Accordingly, the form will hang downwardly in a vertical position when suspended from a rack. The vertical positioning will be maintained even when the rack is tilted at a relatively steep angle. The vertical depth from the top surface 14 of the rack and the top surface 49 of the upper notch 42 is about 1.00 inch thus affording the hanger with considerable strength so that the hanger section is prevented from bending or deforming when suspended from a rack.

Figure 2:
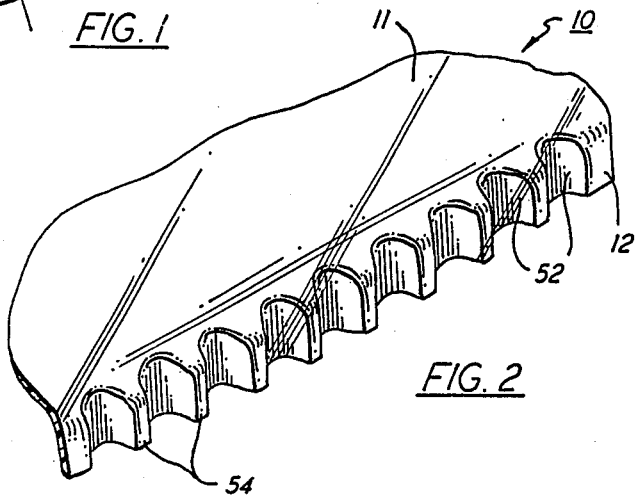
FIG. 2 is a partial perspective view taken along lines 2—2 in FIG. 1 illustrating a series of spaced strap receiving indentations located along the shoulder regions of the form.

The rearwardly turned peripheral wall 12 of the shell along each shoulder of the torso is provided with a series of U-shaped shoulder indentations 52-52 which are shown in greater detail in FIG. 2. These indentations are molded directly into the form at the time of manufacture and are recessed well below the surface of the peripheral wall. Each indentation is separated by a flat wall section 54, and as a result, no sharp or protruding edges are present which might cause harm to one handling the form, or become entangled with foreign objects.

Figure 3:
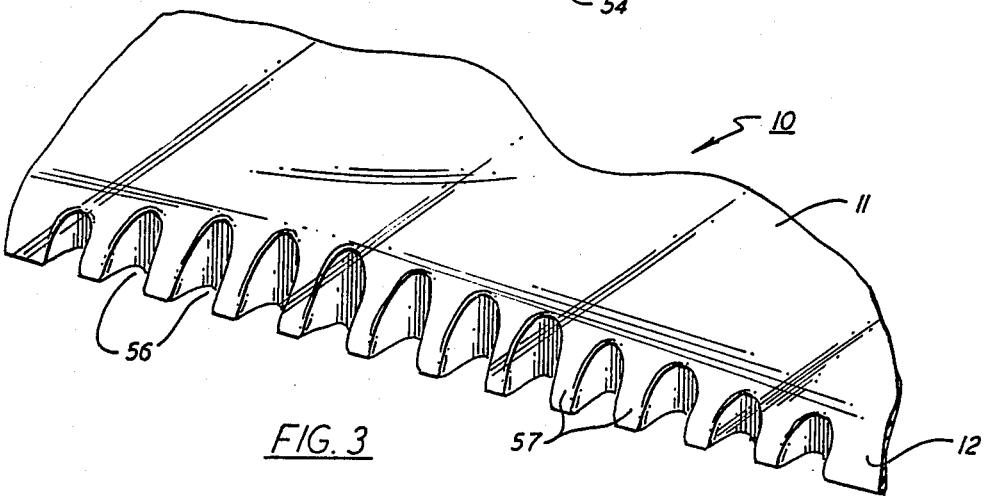
FIG. 3 is also a partial perspective view taken along lines 3—3 in FIG. 1 showing a second set of spaced indentations located along the opposing side walls of the form in the bust region.

As seen in FIG. 3, the peripheral wall on either side of the bust section of the form is similarly provided with relatively deep bust indentations 56-56. Here again, the indentations are molded into the peripheral wall 12 of the form and are separated by flat wall sections 57-57 so that no sharp edges project from the form.

Figure 5:
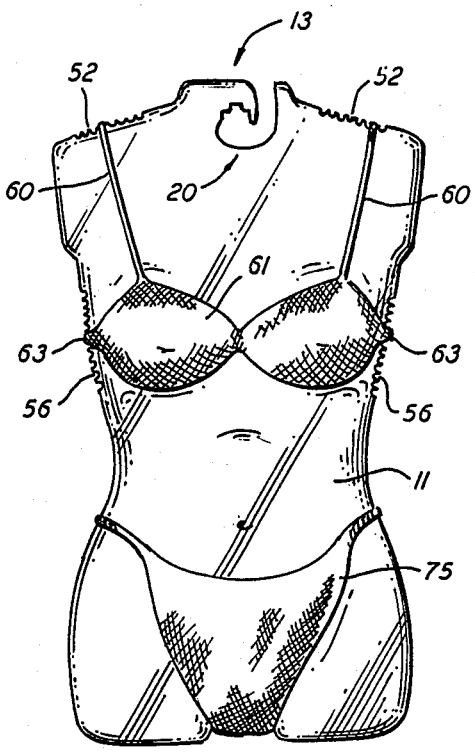
FIG. 5 is a front view of the display form shown in FIG. 1 wherein a two-piece bikini swimsuit is displayed with the halter straps of the swimsuit being supported within the indentations.
Figure 6:
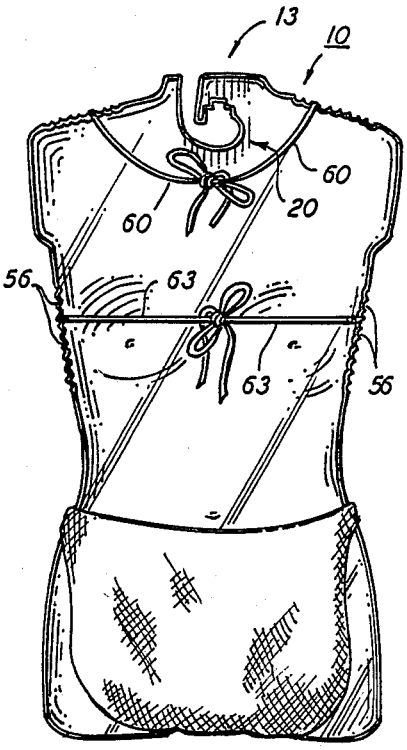
FIG. 6 is a rear view of the form shown in FIG. 5.

The shoulder and bust indentations are sufficiently wide enough to receive therein thin "spaghetti" straps generally associated with today's string-type bikini bathing suits or halter tops. FIG. 5 illustrates the form of the present invention dressed in a string-type bikini. As illustrated, the shoulder straps 60-60 of the halter top 61 can be selectively positioned inside the shoulder indentations so that the halter drapes aesthetically across the frontal section of the form. The thin side straps 63-63 of the halter are also received within the bust indentations and are tied behind the form as shown in FIG. 6 to most effectively locate and support the halter upon the form torso.

Figure 7:
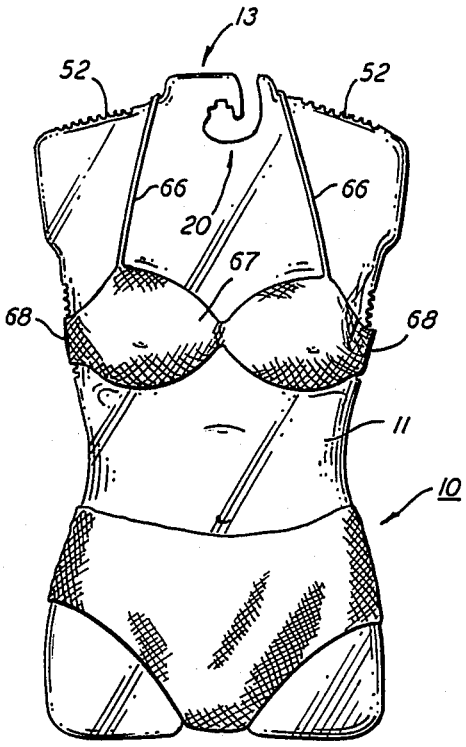
FIG. 7 is a view similar to that shown in FIG. 5 further illustrating the shoulder straps of a halter top crossed behind the raised neck section of the form.
Figure 8:
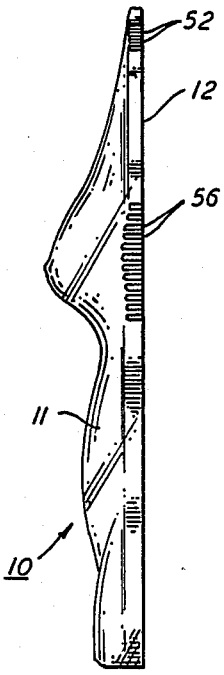
FIG. 8 is an end view of the body form shown in FIG. 1.

Turning now to FIG. 7, the form is shown dressed in a two-piece bathing suit wherein the shoulder straps 66-66 of the halter top 67 are adapted to be crossed behind the neck of the wearer. As previously noted, the present form includes a raised neck section 13 that is centrally located upon the shoulders of the torso. The shoulder straps 66-66 of the halter top 67 are brought about the neck as shown and crossed behind the form in the same manner as they are normally worn, thus giving the garment a natural appearance. The halter displayed in FIG. 7 has two wide back straps 68-68 which are considerably wider than the bust indentations 56-56. Because the bust indentations are separated by flat wall sections 57-57 (FIG. 3), the broad back straps of the garment can be wrapped smoothly about the peripheral wall of the form without causing the straps to be unnaturally distorted or misshaped, again providing the displayed garment with a clean aesthetically natural appearance.

Figure 9:
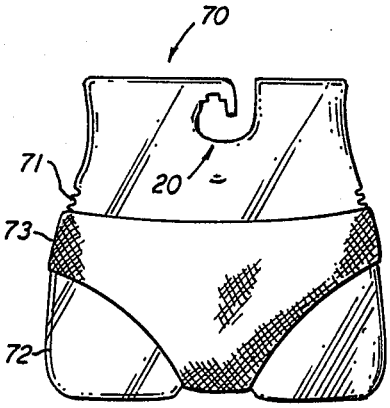
FIG. 9 is a front view of another embodiment of the present invention wherein the molded form replicates the lower section of the human torso and further illustrating a pair of swim trunks displayed upon the form.

Although the recessed hanger slot 20 utilized in the main embodiment of the present invention is ideally suited for use in presenting a full body torso as shown in FIG. 1, it can also be similarly utilized in association with other types of forms depicting lesser parts of the torso. FIG. 9 illustrates a body form 70 similar in construction to the torso form shown in FIG. 1 wherein only the bottom section of the torso is replicated. The form contains a recessed hanger slot 20 having the same geometry as described above. The form may also contain a series of recessed hip indentations 71-71 that are spaced along the opposing hip sections of the form. The indentations are again recessed well beneath the surface of the peripheral wall 72 of the form, and are separated by flat wall sections. A pair of bathing trunks 73 are shown displayed upon the form. As can be seen, the trunks pass smoothly over the hip indentations without distortion. Alternatively, however, a string bikini bottom, such as bottom 75 shown in FIG. 5 having narrow hip straps, can be accommodated on the form. In this mode of display, the thin hip straps again can be passed into the indentations to support the bikini brief in a natural position upon the form.

While this invention has been described in detail with reference to the structure disclosed herein, it should be understood that the invention is not limited to the details set forth and this application is intended to cover any modifications and variations as may come within the scope of the following claims.

What I claim is:

1. A combination garment display form and hanger that includes a molded plastic shell having a vertical face replicating a woman's torso including a neck extending upwardly from a pair of shoulders and a rearwardly turned peripheral wall extending about the perimeter of the shell, said shell having a hanger slot formed in the upper part thereof that includes a contoured aperture centered upon the central axis of the shell and a vertical entranceway passing downwardly through the neck, the contoured aperture further including a circular lower section that open laterally into the entranceway and a notched upper section that includes a first rectangular notch that opens vertically into the circular lower section and a second smaller rectangular notch that opens vertically into the first notch, and said peripheral wall of the shell containing spaced strap receiving indentations recessed into said wall along said shoulders and opposing sides of the shell with adjacent indentations being separated by a flat section of said wall whereby no sharp edges protrude from said form.

2. The form of claim 1 wherein the rectangular notches are both centered on the axis of the form and the horizontal width of the first notch is about twice that of the second notch.

3. The form of claim 2 wherein the vertical depth of the notches are about equal.

4. The form of claim 2 wherein the diameter of the circular lower section of the contoured aperture is about 1.50 inches and the width of the first rectangular notch is about 1.00 inches.

5. The form of claim 1 wherein the vertical shell thickness between the top of the neck and the top of the notched section of the contoured aperture is about one inch.

6. A combination garment display form and hanger that includes a single piece plastic shell having a vertically disposed front face that replicates a portion of a human torso, said shell having a recessed hanger slot formed in the upper part thereof, said slot having a circular aperture centered on the vertical axis of the form which opens laterally into a vertical entranceway that passes upwardly through the top of the shell whereby a circular rod can be seated therein, a first rectangular notch positioned over the circular aperture that opens downwardly into said aperture whereby a first rectangular shaped rod having a cross section that complements said first notch can be seated therein, and a second smaller rectangular notch positioned over the first notch that opens downwardly into said first notch whereby a second rectangular shaped rod having a cross section that complements said second notch, can be seated therein, said shell further including a series of horizontally disposed spaced apart garment engaging indentations formed in the opposite sides of said shell, and a rearwardly turned peripheral wall integral with and perpendicularly disposed from the front face of said shell, said peripheral wall extending in a closed loop about the entire periphery of the shell, the recessed hanger slot, and the garment engaging indentations.

* * * * *